US006783036B1

(12) United States Patent
Haugestad

(10) Patent No.: US 6,783,036 B1
(45) Date of Patent: Aug. 31, 2004

(54) NON-SPILL LIQUID DISPENSING CONTAINER

(76) Inventor: Oyvind Haugestad, 412 Maple St., Colon, MI (US) 49040

( * ) Notice: Subject to any disclaimer, the term of this patent is extended or adjusted under 35 U.S.C. 154(b) by 0 days.

(21) Appl. No.: 10/400,320

(22) Filed: Mar. 27, 2003

(51) Int. Cl.[7] ..... B67D 3/00

(52) U.S. Cl. ..... 222/510; 222/213; 222/518; 215/267

(58) Field of Search ..... 222/212, 213, 222/510, 518; 215/264, 267; 220/262

(56) References Cited

U.S. PATENT DOCUMENTS

| | | | |
|---|---|---|---|
| 897,729 | A | 9/1908 | Foreman |
| 1,558,597 | A | 10/1925 | Eckard |
| 1,607,975 | A | 11/1926 | Werneman |
| 2,319,517 | A | 5/1943 | Rand |
| 2,349,665 | A | 5/1944 | Levit |
| 4,513,883 | A | 4/1985 | Melzi et al. |
| 5,123,570 | A | 6/1992 | Dubow et al. |
| 5,193,719 | A | 3/1993 | Huffman et al. |
| 5,356,042 | A | 10/1994 | Huffman et al. |
| 5,395,000 | A | 3/1995 | Porter |
| 5,464,133 | A | 11/1995 | Drummond |
| 5,692,652 | A | 12/1997 | Wise |

*Primary Examiner*—J. Casimer Jacyna
(74) *Attorney, Agent, or Firm*—Flynn, Thiel, Boutell & Tanis, P.C.

(57) ABSTRACT

A liquid storing and dispensing package comprising a bottle having a dispensing spout, a cap normally closing the dispensing spout for storage, and a push-in portion in the bottom of the bottle. A push rod has a head stored in the spout and responsive to actuation of the push-in portion to emerge with the spout and allow liquid dispensing. In one aspect of the invention, the push rod head can be refixed and resealed within the spout, by one hand of the user, to prevent further dispensing and to save part of the contents of the bottle for late dispensing, prior to the installation of the cap.

18 Claims, 15 Drawing Sheets

60
61

70
45
62
71
41
46
15
43
42
72
47
44
12
40
B 70
62
45
46
41
71
72
44
42
43
47
40
12

NON-SPILL LIQUID DISPENSING CONTAINER

FIELD OF THE INVENTION

This invention relates to a liquid storage and dispensing containers, including those suitable for dispensing motor oil into the oil filler hole of an engine.

BACKGROUND OF THE INVENTION

It has long been known to be difficult to add lubricating oil to an engine through the pouring spout of a conventional oil storage and dispensing bottle (typically of one quart capacity) without spilling some on the engine. Such spilling reduces the motor oil delivered to the engine for use, and leaves oil on external surfaces of the engine. The latter leaves the user with the time consuming and messy task of trying to mop up the spilled oil which, despite best efforts, often leaves a film and/or hidden puddles of oil on the engine, there to attract dirt and place coated electrical cables and their contacts at risk of damage. Typically, the user removes the cap from the spout of the bottle, tips the open end of the spout toward an oil filler hole often tucked down among other engine parts, and hopes that most of the oil stream from the bottle goes into the oil filler hole.

Funnels have been used but are of limited help. Disposable paper funnels have been known to collapse in use and permanent plastic or metal funnels are oil covered after first use, messy to store, and pick up dirt and grit which may be carried, with the next added quart of oil, at some time in the future, into the engine.

In an attempt to overcome these problems, it has been known to provide a bottle for dispensing motor oil having a pouring spout, and a cap normally closing such pouring spout for storage and removable for dispensing, including an elongate push rod having a head stored in the spout and a bottom end advanceable from the bottom of the bottle, after removal of the cap and inversion of the bottle and insertion of the spout into an engine oil filler hole.

Patents have been granted which disclose prior devices of that general type.

For example, Debow, et al. U.S. Pat. No 5,123,570 discloses an oil dispensing bottle in which a push rod extends from a resilient area at the bottom of a bottle into the dispensing spout. A closure at the top of the spout retains oil in the bottle after removal of the cap and inversion of the bottle with the spout down over or in an oil filler opening of an engine. However, the closure is a frangible seal diaphragm and the top of the push rod includes a semi-circular cutter head adapted to partially tear away the frangible seal diaphragm to allow oil flow out the spout and yet prevent the frangible fuel diaphragm from escaping into the engine.

Huffman U.S. Pat. No. 5,356,042 provides an elongate push rod topped by a poppet valve-like head which in storage is normally clamped atop the spout by a threaded cap. After removing the cap, inverting the bottle, and inserting the spout down into the oil filler hole of an engine, the user can advance the push rod further into the spout to push the poppet valve-like head away from the open end of the spout, allowing oil to flow from the bottle into the engine.

However, the present invention provides the substantial improvements over such prior devices. In one aspect of Applicant's device herein disclosed, the user can, with minimal effort and personal contact with the oil being dispensed, push the head back into reliable, fixed, sealing engagement within the spout to stop oil flow from the still partially full bottle, remove the partly full bottle from the vicinity of the engine and thereafter, at leisure, replace the cap on the bottle, should it be desired to add only part of the contents of the bottle to the engine, and save the remaining contents for use at a later time.

In contrast, Debow destroys its frangible seal to enable dispensing and such seal cannot later be restored to sealing engagement with the spout.

Also in contrast, Huffman does not suggest that its poppet valve-like head 13, after being displaced from sealed engagement with the spout for dispensing oil, could, merely by manually pushing the poppet valve-like head back against the top of the spout, restore the oil spill proof seal therebetween. It appears that the user could with one hand push the poppet valve-like head back against the spout. However, that would not appear to establish a self-sustaining sealed closure of the spout by the head. More particularly, grooves on the push rod bottom portion engage the inner annular ribs of the bellows, but in an axially relatively slidable way, with limited friction at most, both to allow assembly of the Huffman device and to allow upward compression of the bellows to push the head up off the top of the spout. The latter causes a length of push rod to be displaced out of its former contact with annular ribs of the bellows and these ribs engage more closely axially spaced points on the push rod bottom portion. Thus, merely pushing the head downward against the spout causes the push rod either to slide further into a relaxed, extended bellows or by friction extend and hence relax the bellows. Thus, the bellows can no longer supply its original downward (inward) pull on the push rod so as to pull the poppet valve-like head sealingly against the top of the spout.

In further contrast to the known prior art, the present invention in at least one of its aspects, positively maintains the push rod head and bottom portion respectively coaxial with the spout and a selected portion of the bottom of the bottle in both of their storage and dispensing positions, avoids substantial reduction in the effective volume of the bottle, avoids requiring reconfiguration of the bottom of the bottle in a difficult to mold shape or addition of further structural elements to the bottom of the bottle, and avoids requiring additional assembly operations to operatively locate the bottom of the push rod with respect to the bottom of the bottle.

These and other advantages of the present invention over the prior art will be apparent upon reading the following description and examining the accompanying drawings.

SUMMARY OF THE INVENTION

This invention relates to a liquid storing and dispensing package comprising a bottle having a dispensing spout, a cap normally closing the dispensing spout for storage, and a push-in portion in the bottom of the bottle. A push rod has a head stored in the spout and responsive to actuation of the push-in portion to emerge with the spout and allow liquid dispensing. In one aspect of the invention, the push rod head can be refixed and resealed within the spout, by one hand of the user, to prevent further dispensing and to save part of the contents of the bottle for later dispensing, prior to the installation of the cap.

Figure 1:
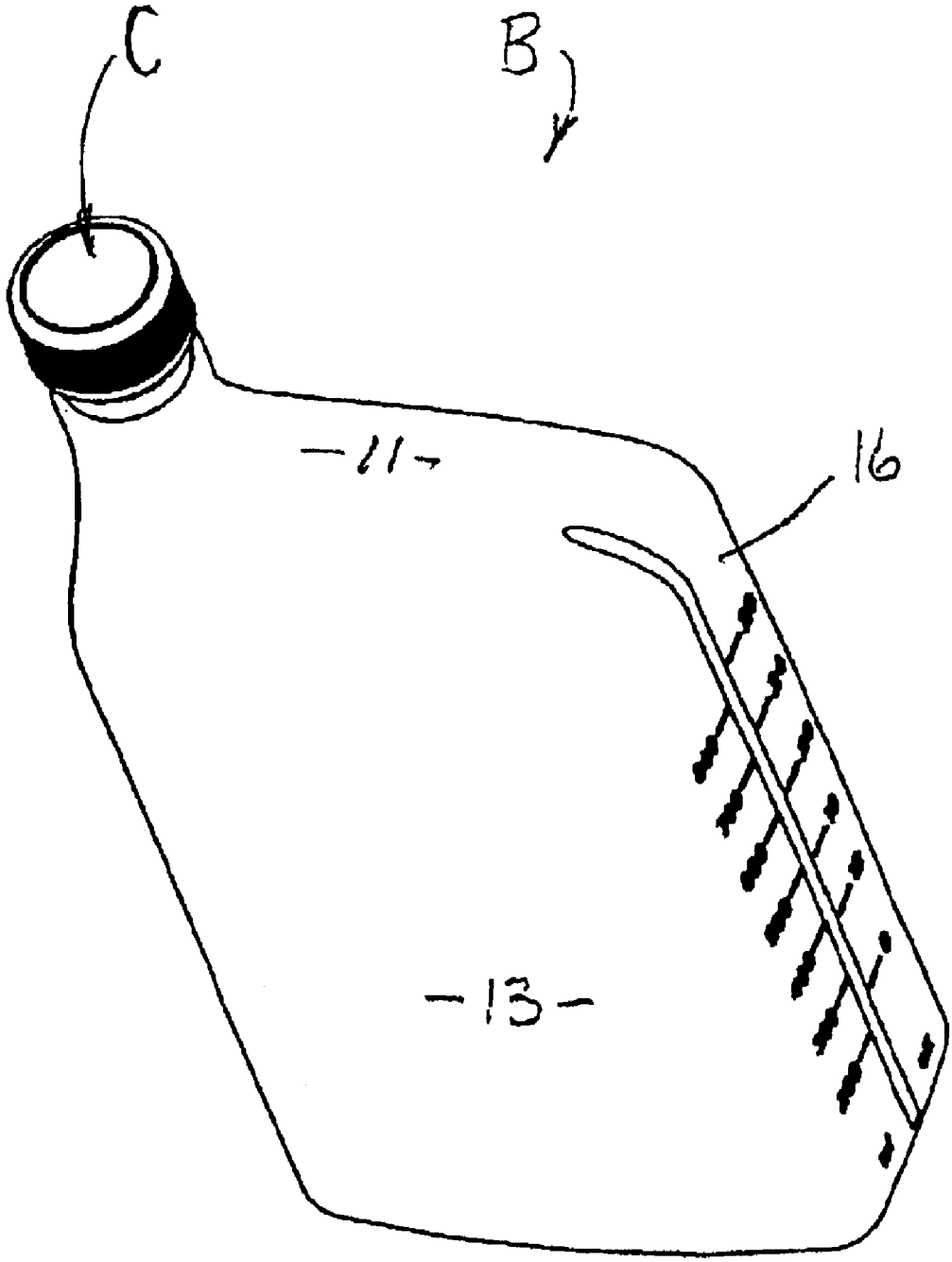
FIG. 1 is a pictorial view of a dispensing package embodying the invention.
Figure 2:
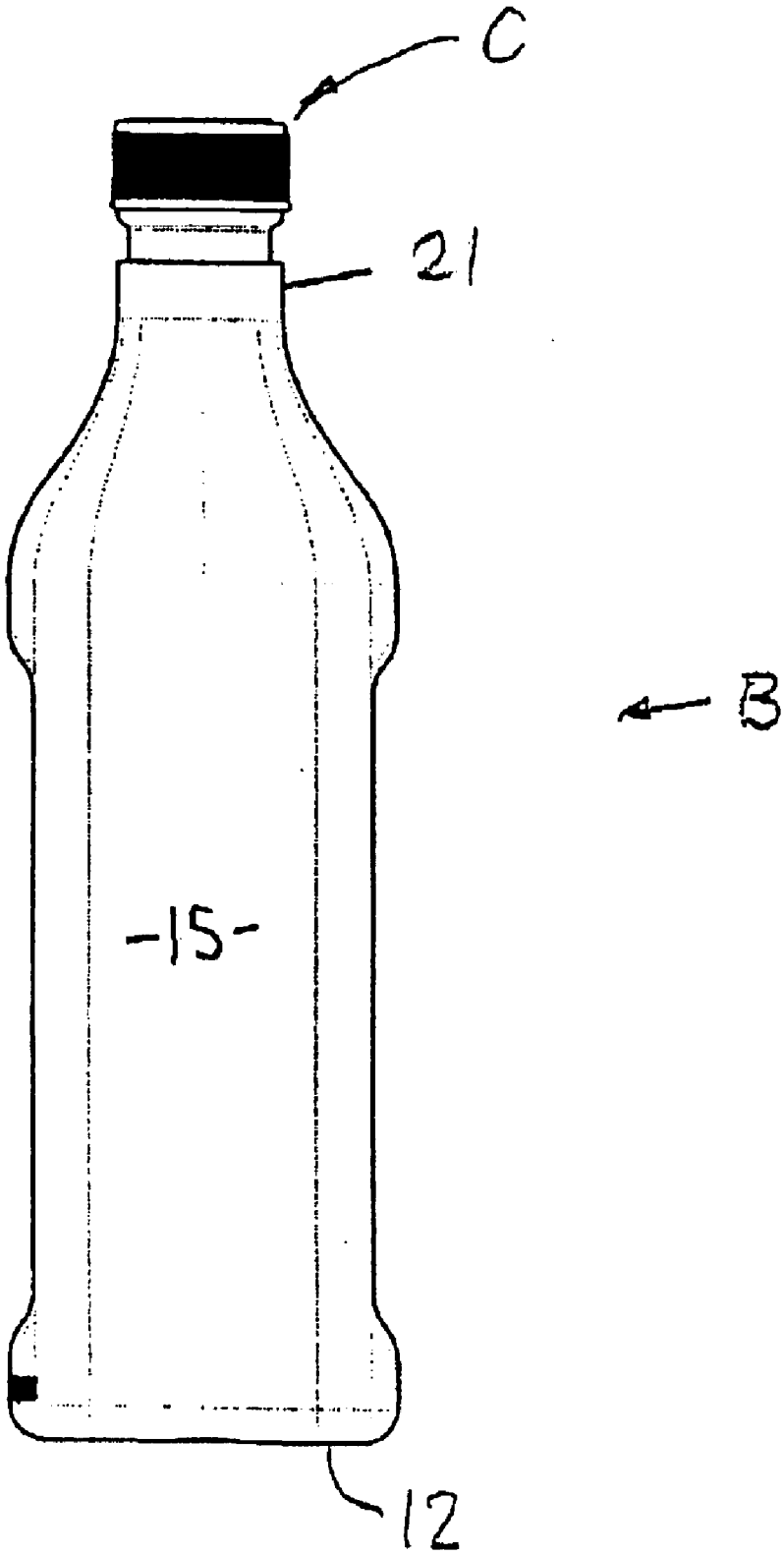
FIG. 2 is a left side view of the FIG. 1 package.
Figure 3:
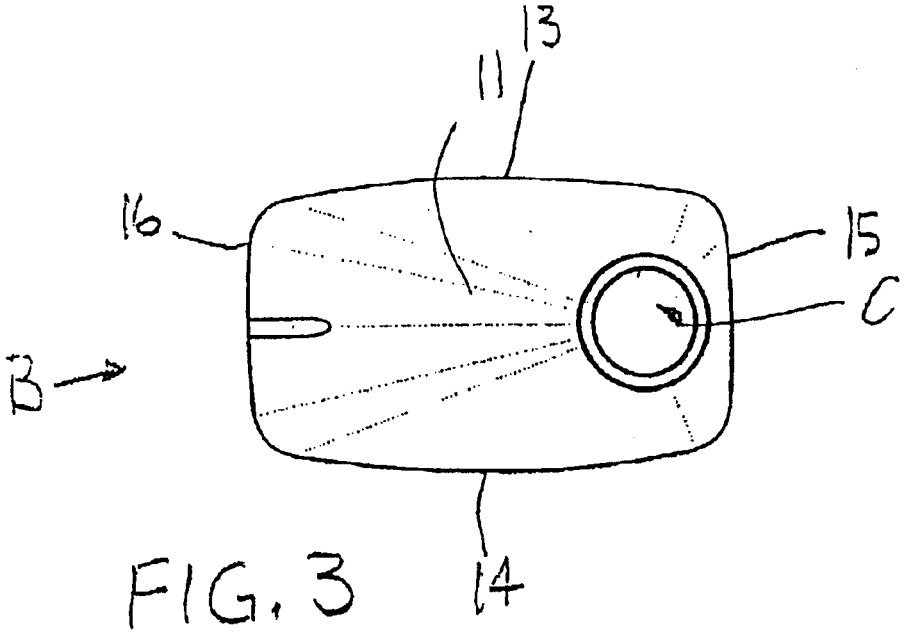
FIG. 3 is a top view of the FIG. 1 package.

A preferred embodiment of the present invention comprises a liquid dispensing package including a bottle B (FIGS. 1–5) which is shaped, by way of present example, like a conventional plastic oil dispensing bottle. Such conventional plastic oil dispensing bottles are typically molded (e.g. blow molded) from thermoplastic sheet material, wherein the walls, while thin relative to the bottle length and width, are shape retaining, but somewhat flexible. Such conventional plastic oil dispensing bottles may be manufactured in various sizes, but in the United States the one quart size is common.

The bottle B has top, bottom, front, rear, long side and short side walls 11, 12, 13, 14, 15, and 16, respectively. The front, rear, and side walls of the bottle comprise a peripheral wall connecting the top and bottom walls and defining therewith a liquid storage chamber. An outlet, or dispensing, spout 21 extends up from the top wall 11 adjacent the long side wall 15. The top wall slopes gradually from the short side wall 16 to the spout 21.

The spout 21 (FIG. 10), as seen from the outside, has intermediate portion defined by an upward facing, annular step 22, an annular rib 23 spaced above the step 22, an external thread 24 spaced above the rib 23 and a top edge 25. The spout 21, as seen from the inside, correspondingly has an intermediate portion defined by a downward facing, annular step 26, an annular groove 27 spaced above the step 26 and an internal thread 28 axially spaced between the annular groove 27 and the top edge 25. The step 26, groove 27 and internal thread 28 respectively are complementary to the step 22, annular rib 23 and external thread 24 above mentioned.

An inverted cup shaped cap C (FIG. 10) has a top wall 30, a generally cylindrical peripheral wall 31 depending from the top wall 30, an internal thread 32 on the inner surface of the peripheral wall 31 and a chamfer 33 on the bottom edge 34 of the peripheral wall 31. In the closed, liquid storage condition (FIG. 7) of the bottle B, the cap C is threaded onto the threaded upper portion of the spout 21. In a conventional motor oil dispensing bottle, the cap C may effect a liquid tight seal with the spout 21 by engagement of its top wall 30 (or in some instances a gasket layer fixed to the underside of the top wall 30 and not here shown) against the top edge 25 of the spout or/and by engaging the chamfer 33 of cap C with the top of the annular rib 23.

To the extent above described, the bottle B and cap C are similar to corresponding parts of a conventional oil storing and dispensing container.

Figure 4:
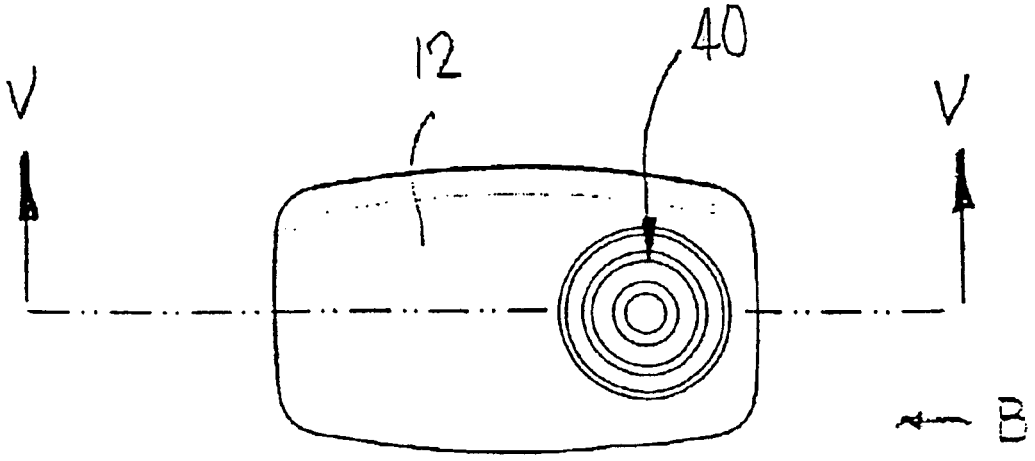
FIG. 4 is a bottom view of the FIG. 1 package in its storage condition.
Figure 5:
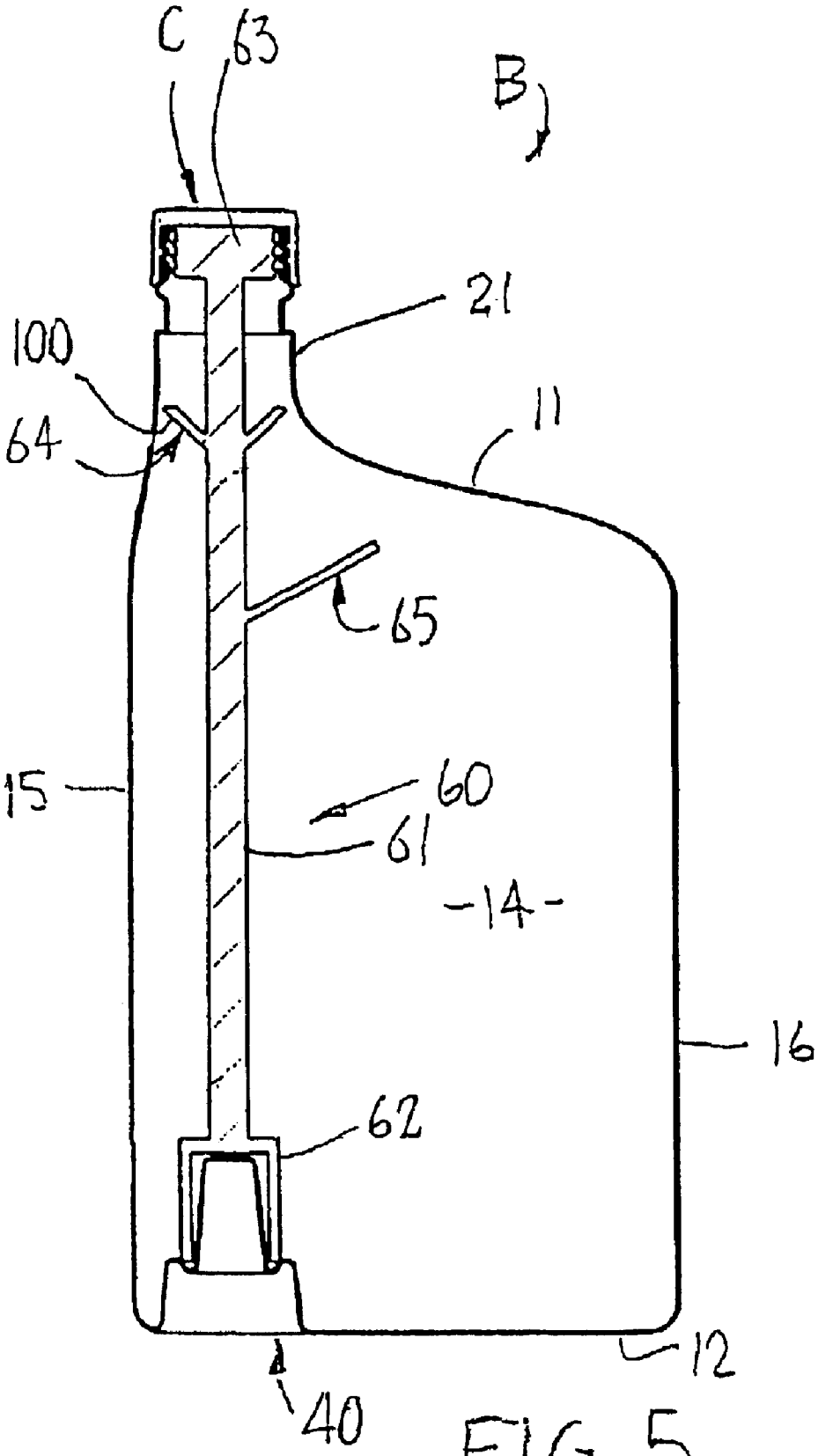
FIG. 5 is a central cross sectional view substantially taken on the line V—V of FIG. 4.
Figure 6:
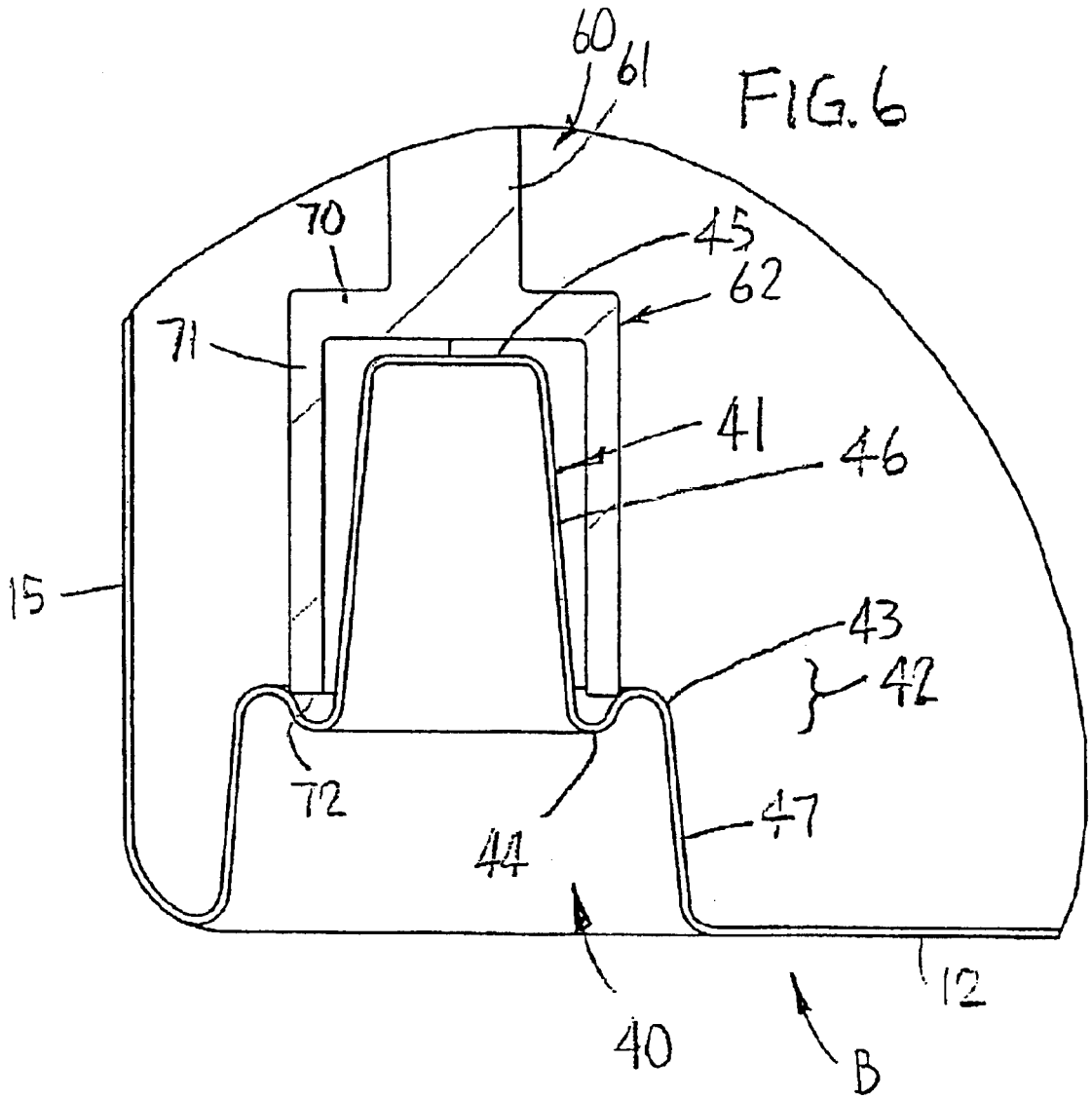
FIG. 6 is an enlarged fragment of FIG. 5.

Turning more specifically to aspects of the present invention, the bottom wall 12 includes a push-in portion 40 (FIGS. 4, 5 and 6). In the FIG. 5 embodiment, the push-in portion 40 is coaxially aligned with the spout 21. The push-in portion 40 (FIG. 6) comprises an upstanding, inverted cup shaped boss 41 and an axially flexible, annular surround 42 connecting the boss 41 to the remainder of the bottle bottom wall 12. The flexible surround 42 preferably comprises a radially outer annular fold 43 extending internally of the bottle from the plane of the bottle bottom wall and a radially inner annular fold 44 radially surrounded by said radially outer annular fold and which extends away from the interior of the bottle, the central boss 41 being surrounded by the annular outer fold 44 and extending beyond same interiorly of the bottle.

The radially outer fold 43 defines a modest depression in the bottom wall 12 of the bottle. The push-in portion 40, and more specifically the annular folds 43 and 44 and boss 41, are conveniently molded as part of the bottom wall 12. At least in its liquid storage position shown in FIGS. 5 and 6, the push-in portion 40, though extending into the interior of the bottle, occupies only a minimal part of its interior volume. Since motor oil dispensing bottles are typically not filled to a level near the top of the spout, the bottle B need be no greater in height, width and depth than a conventional motor oil storage/dispensing bottle, so that the bottle B embodying the invention can be shipped in the same cardboard boxes and displayed in the same shelf space as conventional oil storage/dispensing bottles.

In addition to its liquid storage position (FIGS. 5 and 6), the push-in portion 40 has an alternate, axially inwardly displaced, dispensing position (FIG. 9) wherein the inner annular fold 44 curves continuously axially inward from the radially outer annular fold 43 to the boss 41, thereby eliminating the axial overlap between the boss and outer annular fold discussed above in connection with the FIG. 6 storage position.

Figure 9:
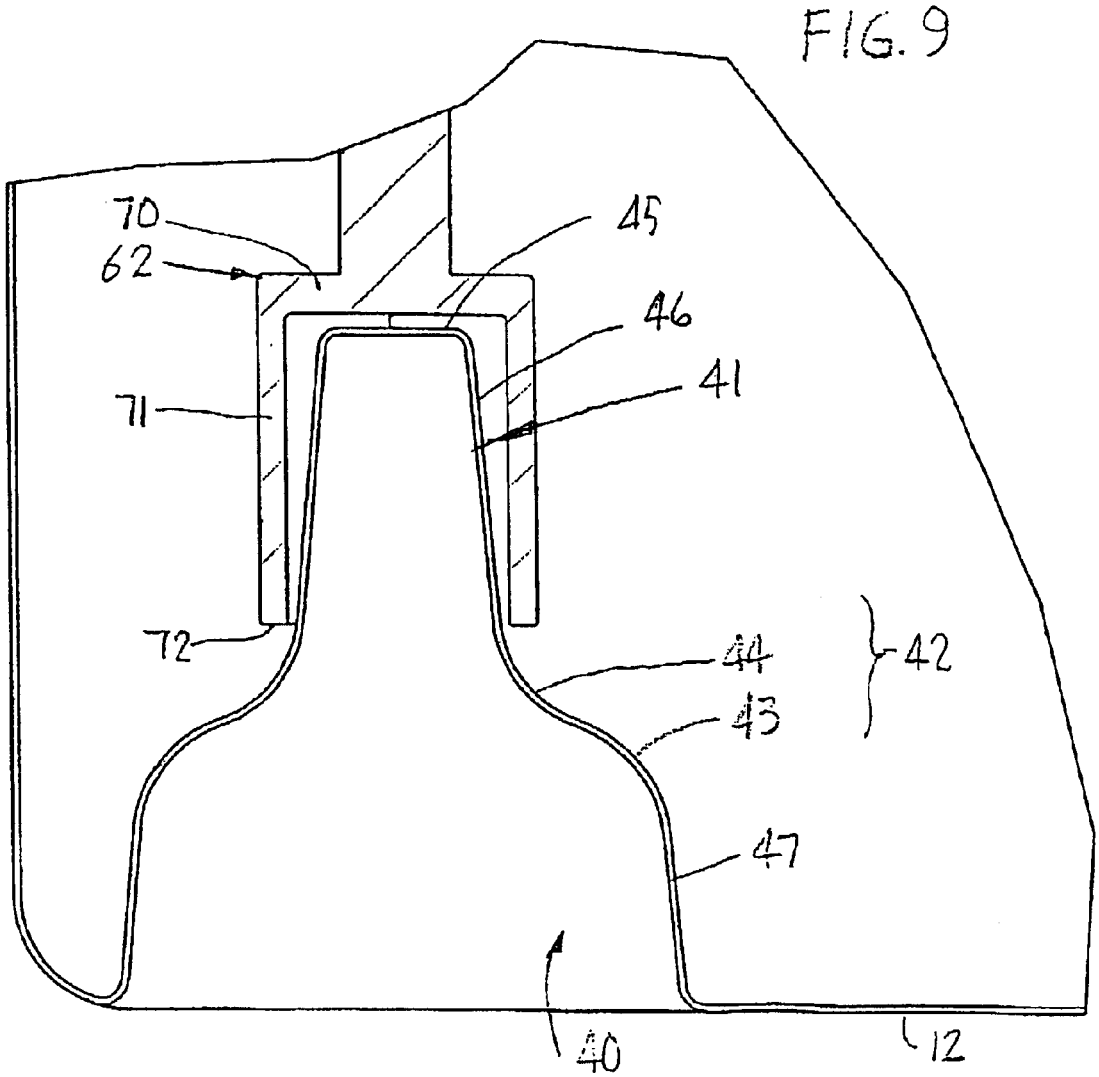
FIG. 9 is a view similar to FIG. 7 but showing the package in a dispensing position.

The inner annular fold 44 is stable in its outward storage position of FIG. 6 and in its axially inward dispensing position of FIG. 9. However, because of the circular symmetry of the push-in portion 40, the radially inner annular fold 44 is stressed, and thereby unstable, in positions between its FIG. 6 storage and FIG. 9 dispensing positions, such that a partial displacement inward of the bottle from its FIG. 6 position will, upon release and depending on the extent of inward displacement will either snap back outward to its outward FIG. 6 storage position or inward to its inward FIG. 9 dispensing position.

Thus, the radially inner annular fold 44, as it connects between the radially outer fold 43 and boss 41, defines therewith a "snap action", axially displaceable, push-in portion (or "push button") having, as mentioned, stable outward storage, and inward dispensing positions.

In the embodiment shown in FIG. 6, the inverted cup-shaped boss 41 has a substantially flat end wall 45 and a peripheral wall 46 connecting such end wall to the inner fold 44, and an annular skirt 47 connecting the outer fold 43 to the bottle bottom wall 12. The boss peripheral wall 46 and skirt 47 are preferably inward tapered and frustoconical in shape, for example to maintain the parts of the push-in portion 40 coaxial, and thereby guard against any tendency of the push-in portion 40 to bend laterally in use, and to facilitate molding of the push-in portion 40 integrally in the bottom wall 12 of the bottle.

The risk of accidental inward displacement of the boss 41 is minimized by inwardly recessing, from the bottom wall 12, of the inwardly snappable portion 44 and by radially spacing same remote from the central axis of the push-in portion 40 and close to the skirt 47, and by making the height of the boss 41 a major part of the total height of the push-in portion 40. In this way, standing the bottle B on an uneven surface, such as a gravel driveway, is not likely to accidentally displace the boss 41 inward of the bottle.

The inventive liquid dispensing package of FIG. 1 further includes an elongate push rod 60 having a liquid storage position (FIG. 5) in the bottle B. The push rod 60 includes an elongate, generally longitudinally movable shaft 61 which, in the FIG. 5 embodiment, extends coaxially of push-in portion 40 and spout 21. The push rod 60 further includes an inverted, cup-shaped base 62 coaxially fixed to the bottom of the shaft 61, a plug-like head 63 coaxially fixed to the top of the shaft 61, a keeper member 64 fixed to the shaft 61 below the head 63 and a keeper bar 65 fixed to the shaft 61 in axially spaced relation between the keeper member 64 and base 62.

The cup-shaped base 62 comprises an upper end wall 70 extending radially from the bottom end of the shaft 61 and a peripheral skirt 71 fixedly coaxially depending from the end wall 70. In the embodiment shown, the skirt is cylindrical and of cross section (preferably circular) corresponding to that of the peripheral wall 46 and folds 43 and 44 of the boss 41. The inverted cup-shaped base 62 (FIG. 6) receives the boss 41 with a radial clearance. In the embodiment shown, the bottom edge 72 of the base 62, in its FIG. 6 storage position, coaxially seats along the upper inner surface portion of the radially outer fold 43 and is spaced above the radially inner fold 44. This may leave a small axial clearance between the end walls 45 and 70, respectively, of the boss 41 and base 62. Alternately, the end wall 70 of the base 62 may ride atop the end wall 45 of the boss 41 which, if desired, would permit a slight clearance between the base bottom edge 72 and radially outer annular fold 43. In its dispensing position (FIG. 9), the end wall 45 of the boss 41 may abut or, preferably, slightly clear the end wall 70 of the base 62. The bottom edge 72 of the base 62 has a slightly larger inside diameter than the outside diameter of the portion of the boss 41 which it radially opposes, such that the push rod base 62 remains substantially coaxial with the push-in portion 40 while substantially preventing scuffing of the bottom edge 72 of the base 62 on the opposed surface of the boss 41.

Figure 7:
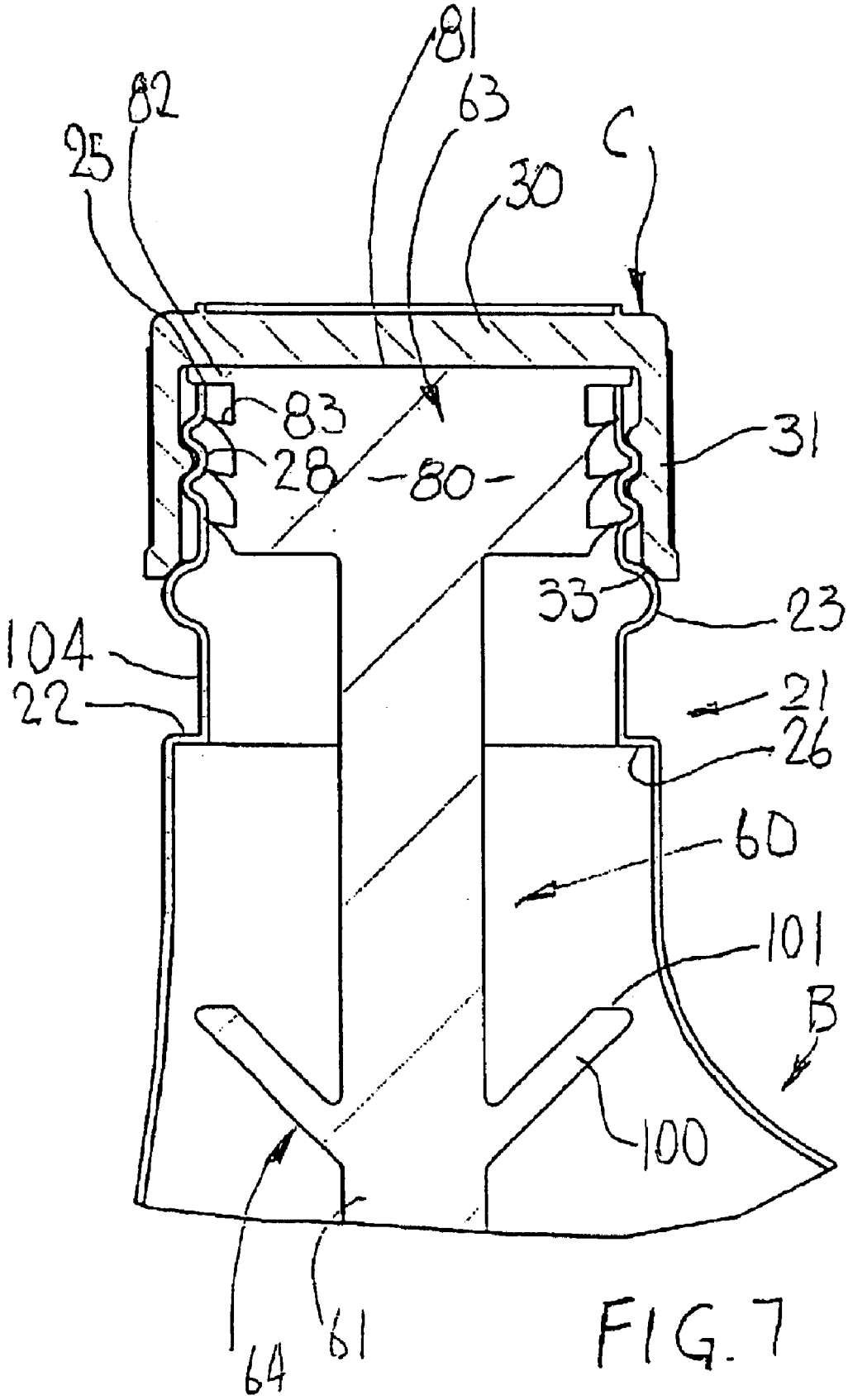
FIG. 7 is an enlarged fragment of FIG. 5.

The head 63 (FIG. 10) comprises a top surface 81 and an annular flange 82 extending radially from the body 80 substantially coplanar with the top surface 81. The diameter of the annular flange is equal to or slightly greater (as seen in FIG. 7) than the outside diameter of the top edge 25 of the spout 21 so as to abut the latter in the FIG. 7 storage position of the head 63. On the other hand, the diameter of the annular flange 82 is not more than the inside diameter of the internal threads 32 of the cap C, to allow the cap C to be telescoped over the head 63.

The head 63 further includes at least one, generally circumferentially extending, flexible fin 83 (FIG. 10) radially extending from the periphery of the body 80 below the flange 82. The fin 83 extends radially toward, and into interfering relationship with, the inward facing ridges of the internal thread 28 of the spout 21 in the storage position of the apparatus shown in FIG. 7. The periphery of the head 63 is spaced radially from the threaded inner surface of the spout 21 at a distance preferably substantially exceeding the radial depth of the threads 28. In one unit constructed according to the invention, the fin 83 had about three times the radial extent of the peak-to-valley depth of the spout internal thread 28, whereas the distance between the head peripheral wall and the peaks of the internal threads 28 was about twice the peak-to-valley thread depth, such that the fin 83, in the FIG. 7 storage position of the head 63, radially overlapped the peaks of the threads 28 and protruded into the valleys thereof.

Figures 10, 10A:
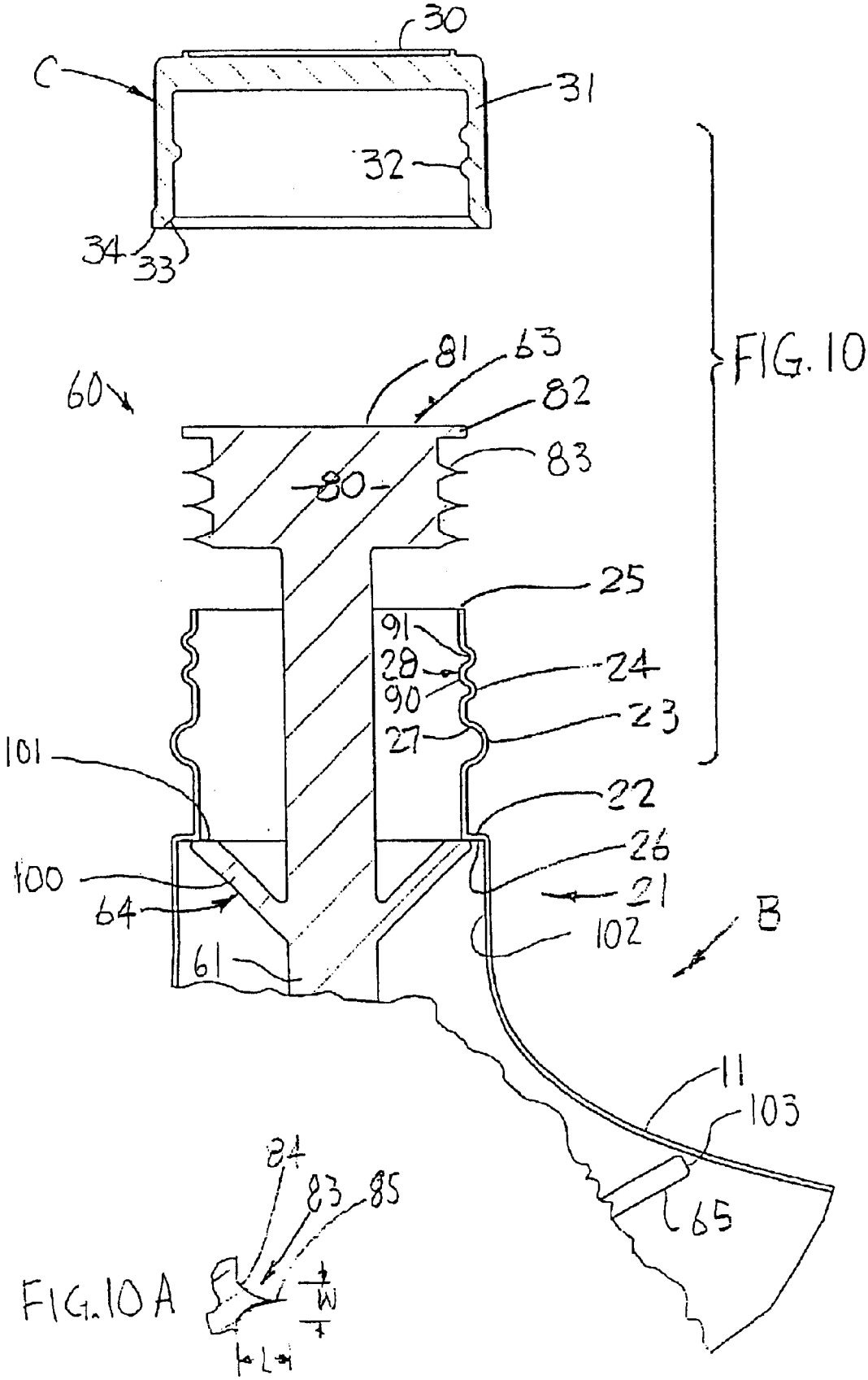
FIG. 10 is a view similar to FIG. 7 but showing the package in a dispensing position.
FIG. 10A is an enlarged fragment of FIG. 10.

The cross section of a given fin 83 (FIGS. 10 and 10A) is generally tapered and radially elongate. When relaxed (FIG 10A), it is preferably symmetrical with respect to its central radial plane. In the preferred embodiment shown, the fin 83 (FIG. 10A) has a width W of about two thirds its length L, the W and L dimensions being taken respectively in directions axially and radially of the head 63. As seen in FIG. 10A, the top and bottom faces 84 of the fin 83 are somewhat concave in cross section such that the radially outer portion (here about the radially outer one third) 85 of the fin 83 approaches a constant though very small thickness (e.g. about 0.40 inch, or at least in the range of 0.25 to 0.50 inch), so as to define substantially a feather edge. The fin 83 is elastically bendable in the axial direction of the head 63 downward and upward (upwardly as schematically indicated in FIG. 7). Due to its cross sectional shape, the fin 83 may tend to be progressively more readily bendable as one proceeds radially outward from the body 80 of the head 63 toward the outer, feather edge portion 85 of the fin. In one embodiment constructed according to the invention, the radial extent of the fin 83 was in the range of 20–30% of the radius of the body 80 (e.g. about 25% thereof). The outer radius of the fin 83 exceeds the radius of the hills 90, so as to axially overlap same, and preferably at least approaches the radius of the valleys 91 (FIG. 10) of the internal thread 28, so as to bear flexibly on and sealingly against the axially outward (upward in FIG. 7) faces of the internal threads 28 in the closed, FIG. 7, storage position of the head 63 in the spout 21. In one embodiment constructed according to the invention, and as seen in FIG. 10, the fin 83 and annular flange 82 conveniently have the same outer radius (i.e. are at their radially outer edges substantially axially aligned).

In the FIG. 7, 10 embodiment, there are multiple fins 83 (here three in number) and the fins 83 are annular. These ring-like fins 83 are axially spaced from each other from the flange 82, the bottom fin 83 being adjacent the bottom of the body 80. The axial spacing of the fins 83 is preferably about the same as the axial spacing of the hills 90 of the internal thread 28. In the embodiment shown in FIG. 7, with the head 63 in its bottom, closed, storage position, the array of fins 83 extends from about the lowermost point of the internal thread 28 to about the uppermost point thereof.

The keeper member 64 (FIG. 10) comprises plural, circumferentially spaced keeper portions, which in the embodiment shown conveniently comprise two diametrically extending arms 100. The radially outer ends 101 of the arms 100 (FIG. 10) radially overlap the step 26 and are sufficiently close to the interior surface 102 of the spout 21, inboard of the step 26, as to positively prevent sufficient radially outward bending of the arms 102 axially away from the step 26 and toward the bottom 12 of the bottle B. Thus, the arms 100 positively block upward removal of the push rod 60 from the bottle B, with the arms 100 disposed inward (below in FIG. 10) the step 26.

The arms 100 are preferably acutely angled from the shaft 61 upward toward the step 26, the arms 100 thus being obtusely angled with respect to the shaft 61 in a direction toward the bottom wall 12 of the bottle B. The arms 100 are thus radially inwardly bendable sufficient to allow the upper ends 101 thereof to slide along the interior surface of the spout 21 above the step 26, upon downward insertion of the push rod 60 through the spout 21 and into the bottle B during assembly, as hereafter discussed.

Figure 8:
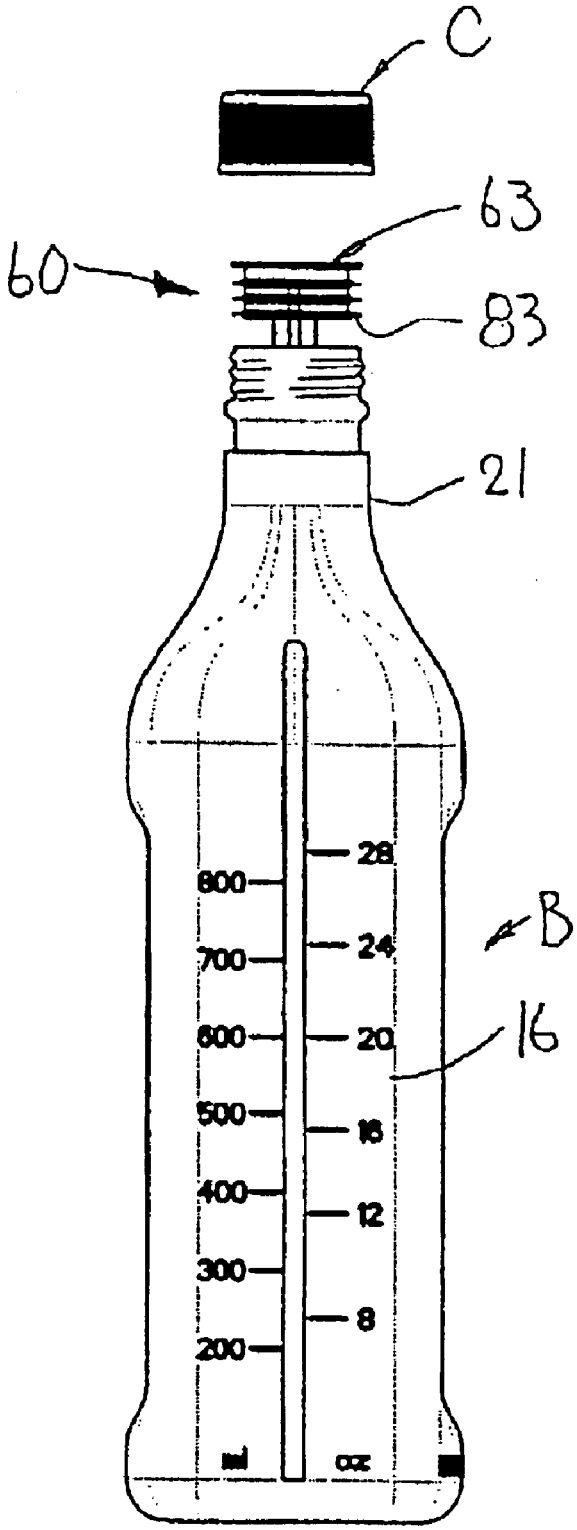
FIG. 8 is a right side view of the FIG. 1 package.

The keeper bar 65 (FIG. 5) is spaced below and of length greater than the arms 100. The keeper bar 65 underlies and is acutely angled upward toward the central portion of the top wall 11 of the bottle B. The acute angle of the keeper bar 65 may be somewhat greater (the keeper bar being somewhat more close to the horizontal in FIG. 5) than that of the arms 100. With the push rod 60 in its FIG. 5, 7 storage position, contained within the bottle B, the keeper bar 65 is spaced below the corresponding portion of the top wall 11 of the bottle B by an amount similar to, but preferably slightly greater than, the spacing of the arms 100 below the down facing internal annular step 26. In its upwardly extending, dispensing position of FIG. 8 and 10, the push rod 60 is located such that the arms 100 bear at their upper ends 101 against the down facing internal annular step 26, the head 63 is spaced above the top edge 25 of the spout 21 by an adequate, flow permitting amount (hereby about 22–30%, preferably about 25%, of the diameter of the spout 21 at its top edge 25) and the upper, outer end 103 of the keeper bar 65 lies closely adjacent and beneath the bottle top wall 11.

In the preferred embodiment shown in FIG. 5, the push rod 60, with its shaft 61, base 62, head 63, keeper arms 64 and keeper bar 65, is a one piece unit and is conveniently molded of a suitable, substantially rigid plastics material, the arms 100 and keeper bar 65 being sufficiently bendable as to enable downward insertion of the push rod into the bottle B through its spout 21. Suitable plastics materials include polypropylene, and in one unit embodying the invention, such material was polypropylene. The cap C and body B are preferably molded in a conventional manner and from conventional materials such as, respectively, nylon and polypropylene, as used in conventional prior liquid (e.g. motor oil) storage and dispensing containers. Such a conventional bottle material, in sheet form as in conventional prior bottles, has sufficient flexibility and elasticity to enable the above mentioned molding and snap action of the push-in portion 40.

The apparatus is assembled as follows. With the cap C removed, the bottle B is conventionally filled with liquid (e.g. motor oil) to be stored and dispensed, through its spout 21. The push rod 60 is then inserted lower end portion (i.e. base 62) first downward through the spout 21, the arms 100 and keeper bar 65 bending upward as needed, and in an elastic manner, to pass through the spout 21. Insertion of the push rod 60 is complete in its FIGS. 5, 7 position, with the base 62 resting on the push-in portion 40 in its lower, storage, FIG. 5 position, the keeper bar 65 spaced below the bottle top wall 11, the arms 100 spaced below the downward facing annular flange 26 of the spout 21, and the head 63 located in its lower, storage, FIG. 7 position, with its annular fins 83 somewhat upwardly flexed and resting in sealing manner against interior surface of the threaded portion 28 of the spout 21 and its top flange 82 resting atop the top edge 25 of the spout 21. Adding the cap C completes assembly of the filled container B, C. The peripheral wall 31 (FIG. 7) of the cap C, in accord with recent prior practice, may have frangibly connected to its lower edge a suitable skirt (not shown) which would extend downward around the external annular rib 23 and surround the shank portion 104 (FIG. 7) of the spout 21 between the annular rib 23 and upward facing step 22. Such a skirt (not shown) helps prevent inadvertent unthreading of the cap C prior to dispensing and the unbroken connection of the skirt (not shown) and cap C shows the ultimate purchaser of the filled container B, C that its contents are untampered with and in the same condition as when the container B, C left the bottling (manufacturing) facility.

Following purchase, and for the sake of example considering the container B, C to be filled with conventional motor oil, the user takes the filled container B, C (in its storage position shown in FIGS. 1–7) to a vehicle, opens the hood thereof, and removes the filler cap to expose the oil filler hole of the engine. Such vehicle hood, filler cap, oil filler hole and engine may be of well known conventional type and so need not be shown. The user then removes the cap C, and inverts the bottle B so that its spout 21 is aimed generally downward. With the cap C removed and the bottle B inverted (spout 21 downward) and the push-in portion 40 still in its FIG. 6 storage position, frictional engagement of the fins 83 with the internal thread 28 of the spout 21 maintains the head 63 in its FIG. 7 storage position, with the top flange 82 thereof bearing against the top edge 25 of the spout, and the fins 83 and top flange 82 independently prevent oil leakage from the spout 21 of the inverted bottle B. This is in contrast to conventional motor oil dispensing bottles of the popular type wherein, after removal of the cap, inverting of the bottle results in instantaneous rush of oil out of the bottle through the spout, even if the spout is not yet coaxially aligned with, or inserted into, the engine oil filler hole, such that part of the oil in the bottle may be accidentally dispensed onto outer surfaces of the engine, in an unwanted way, rather than into the engine oil filler hole.

The user then coaxially aligns the spout with (and preferably inserts the spout into) the oil filler hole of the engine. The user then, by means of a thumb or finger, pushes the push-in portion 40, and more particularly the radially inner annular fold 44 thereof, inward of the bottle, from its FIG. 6 storage position to its FIG. 9 dispensing position. After sufficient axially inward displacement, the fold 44 tends to snap axially inward to its FIG. 9 position and so is stable in that position. This inward displacement of the push-in portion 40 forces the push rod 60 axially away from the bottle bottom wall 12 (upwardly in FIGS. 7 and 10), so that the base 62, keeper bar 65, keeper arms 100 and head 63 assume their spout opening, liquid dispensing position of FIG. 10.

In that position, gravity drains motor oil from the bottle B past the head 63 and into the oil receiving portion of the engine. The close spacing of the upper ends 101 of the arms 100 radially from the portion of the spout 21 immediately below the annular flange 26, and the snug telescoping of the inverted cup shaped base 62 over the boss 41, maintain the head 63 essentially coaxial with, though spaced beyond, the end 25 of the spout 21, so that the gravity flow of oil past the head 63 (FIG. 10) tends to be of about the same radial thickness and axial flow rate all the way around the head 63 and such that the flow oil past the head 63 tends to remain coaxial with the outboard portion 23–25 of the spout 21, i.e. the head 63 does not tend to deflect the flow of oil, as a whole, at an angle to the central axis of the spout 21. Thus, even with the spout 21 spaced coaxially above the engine oil filler hole, rather than disposed therein, the head 63, in its FIG. 10 dispensing position, will direct the flow of oil coaxially from the spout 21 into the engine oil filler hole rather than deflect flow away from the latter.

With the spout 21 of the inverted bottle B inserted in the engine oil filler hole (or located coaxially thereabove) the ends 101 of the keeper arms 100, bearing axially against the inward facing annular step 26, positively prevents the push rod 60 from dropping out of the bottle B and, for example, into the engine oil filler hole. The keeper bar 65 would perform a similar function if the arms 100 were absent, but in the presence of such arms 100, the keeper bar 65 simply acts as a potential back up against dropping of the push rod 60 out of the inverted bottle B.

If it be desired to dispense only a portion of the oil in the bottle into the engine oil filler hole, and retain the remaining portion of the oil in the bottle B for later use, such can be done by raising the inverted bottle B so that the extended head 63 is spaced coaxially above the engine oil filler hole at least by a finger thickness. The user may then place a finger against the end surface 81 of the head 63 and push the latter coaxially back into its FIG. 7 storage position, with the fins 83 frictionally engaging the internal thread 28 of the spout 21 and bent somewhat in an axially outward direction, as shown in FIG. 7, to increase frictional resistance to removal of the head 63 from its FIG. 7 storage position in the bottle B. In this way, the top flange 82 is held snugly against the spout top edge 25 which, together with the bearing of the fins 83 against the internal threads 28 of the spout 21, tends to prevent further flow of oil from the spout 21 of the inverted bottle. The still partially filled bottle B can then be removed from the vicinity of the engine and returned to its normal upright position shown in FIG. 5. While this step may result in oil on the lifting finger of the user, even that may be avoided by substituting, for such finger, the tip of a screw driver, a stick, or the like.

Note that, during the steps discussed above, the base 62 of the push rod 60 remains coaxially telescopingly trapped on the boss 41 of the push-in portion 40 and so cannot swing laterally toward the front, back or sides of the bottle B, thereby positively avoiding any likelihood of the push rod head 63 becoming cocked, or angled out of coaxial relation with, the spout 21.

Modification

Turning now to the embodiment of FIGS. 11–16, parts similar to corresponding parts of the above described FIGS. 1–10 embodiment will carry the same reference numerals, whereas corresponding parts which are modified will carry the same reference numerals with the suffix A added thereto.

It will be understood that the FIGS. 11–16 embodiment is similar to that of the above described FIGS. 1–10 embodiment except to the extent hereafter discussed.

Figure 15:
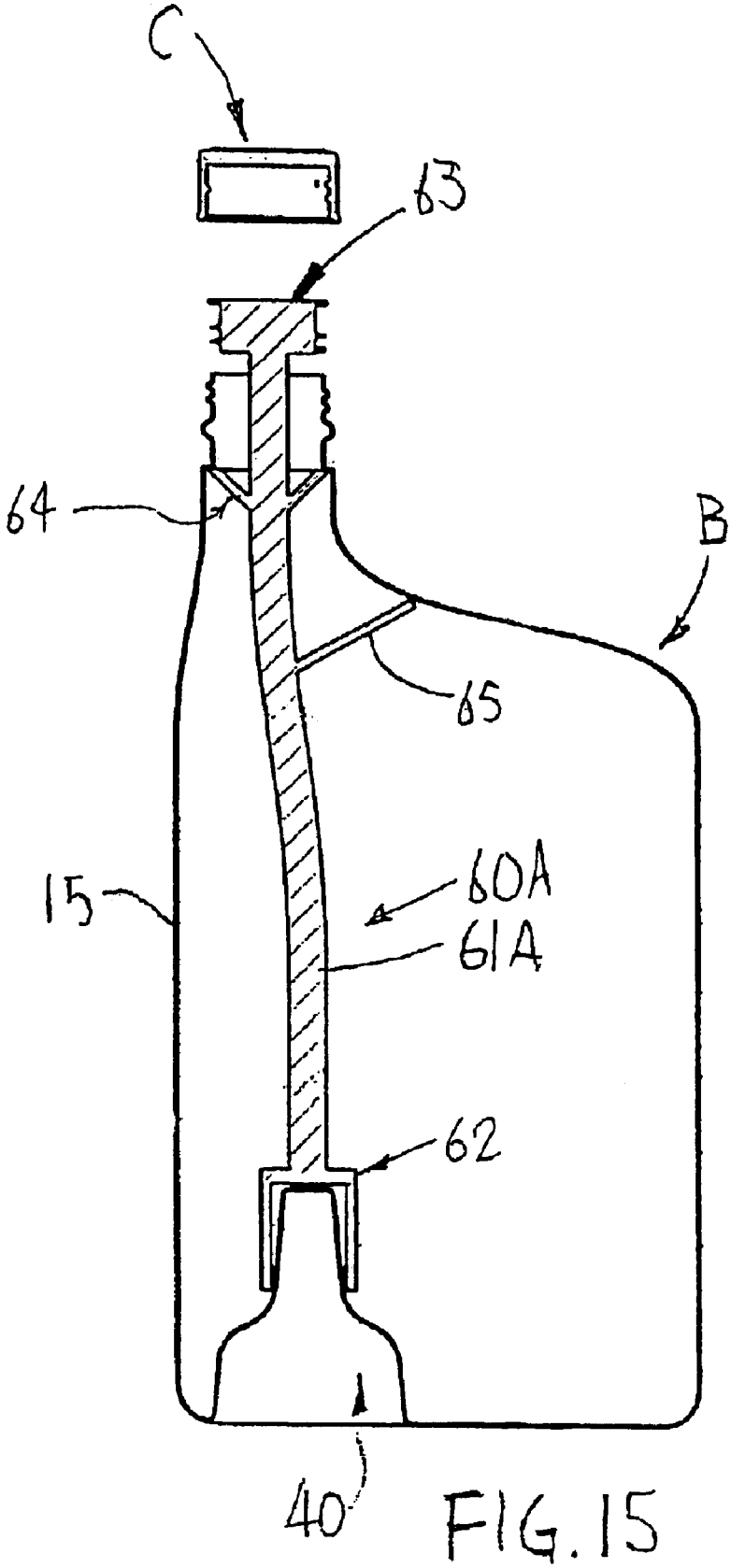
FIG. 15 is a central cross-sectional view substantially taken on the line XV—XV of FIG. 14.

The FIG. 15 push rod 60A differs from the FIG. 5 push rod 60 in not being straight, but rather in laterally displacing the central axes of the head 63A and base 62. Thus, in the embodiment shown in FIG. 15, the mid-portion of the shaft 61A, of the push rod 60A, is provided with a shallow sinuous curvature (shallow S shape). This may be convenient if, for example, it is desired that the push-in portion 40 be located somewhat further from the long side 15 of the bottle B.

Figure 16:
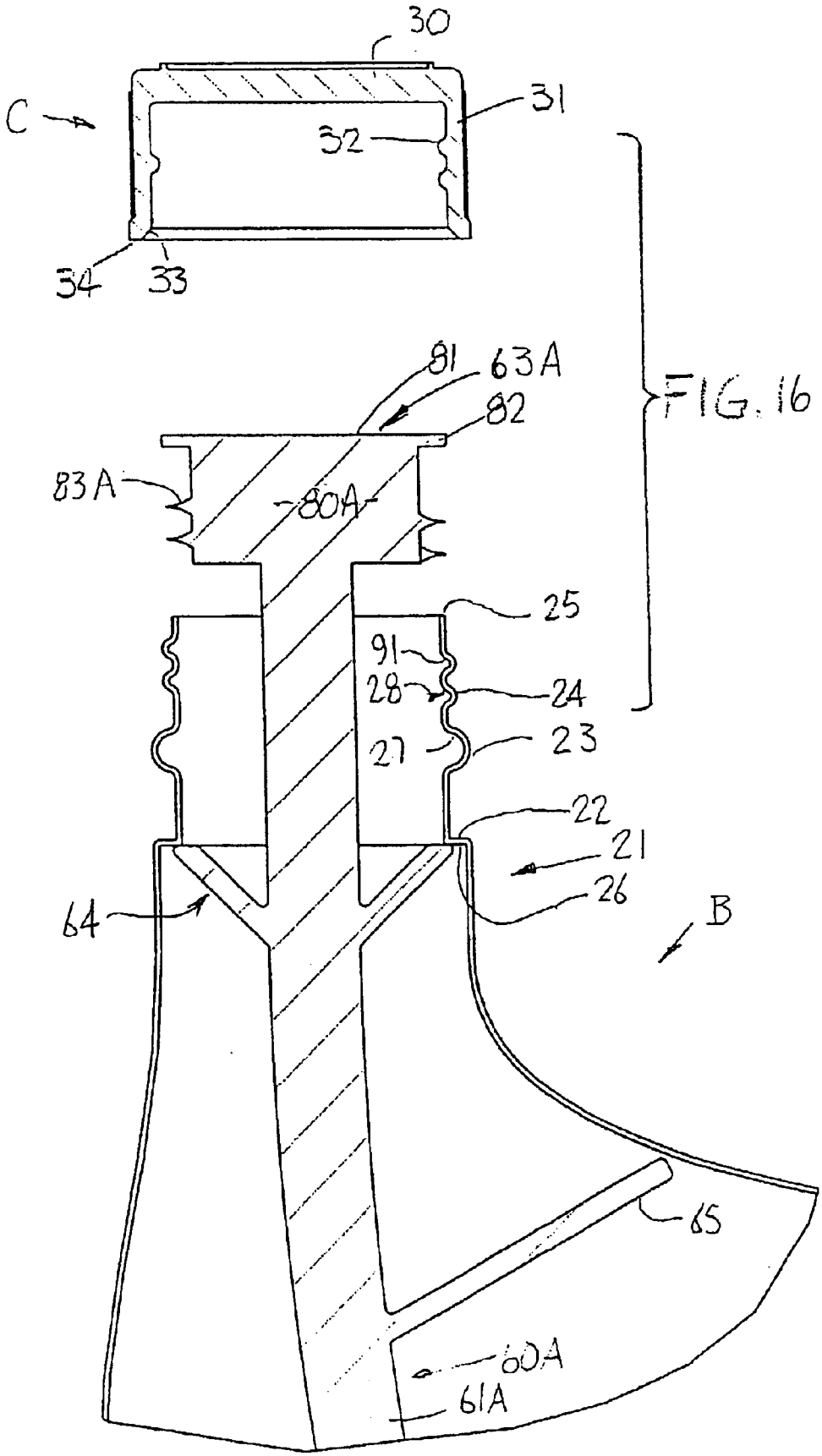
FIG. 16 is an enlarged fragment of FIG. 15.

Also, whereas the fins 83 of FIG. 7 are ring-like, the FIG. 16 head 63A has a fin (or fins) 83A which, though generally circumferentially extending, extends thread-like in a shallow spiral around the periphery of the head 63A. In the FIG. 16 embodiment, the pitch of the thread-like spiral of the fin 83 is preferably identical to that of the internal thread 28 of the spout 21. Thus, in the closed, storage, FIG. 11 position, the spiraling fin 83A extends continuously along the valleys 91 of the internal thread 28 of the spout 21 and continuously seals against surface of the internal thread 28.

Figure 11:
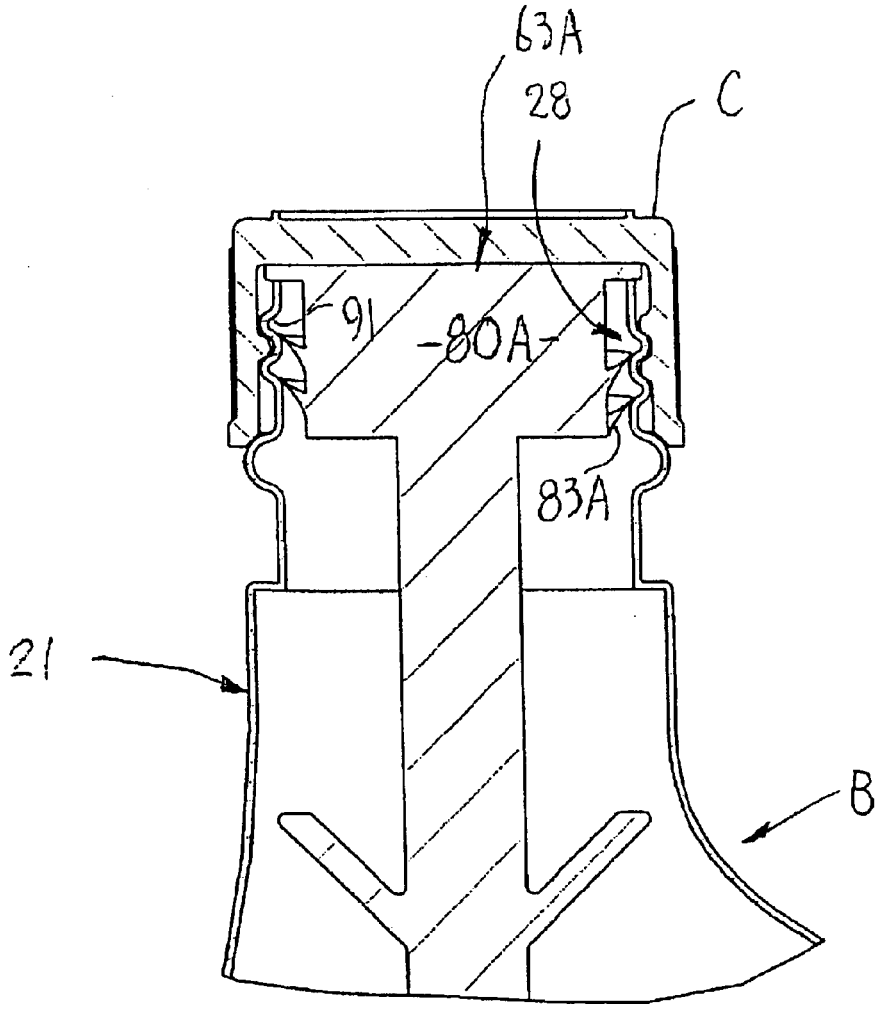
FIG. 11 is a view similar to FIG. 7 but showing a modified embodiment.
Figure 11A:
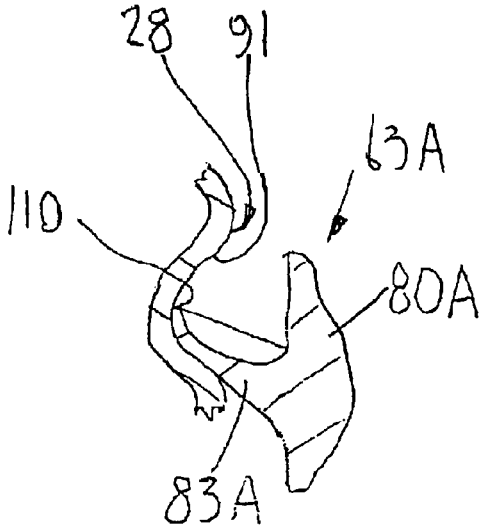
FIG. 11A is an enlarged fragment of FIG. 11.
Figure 12:
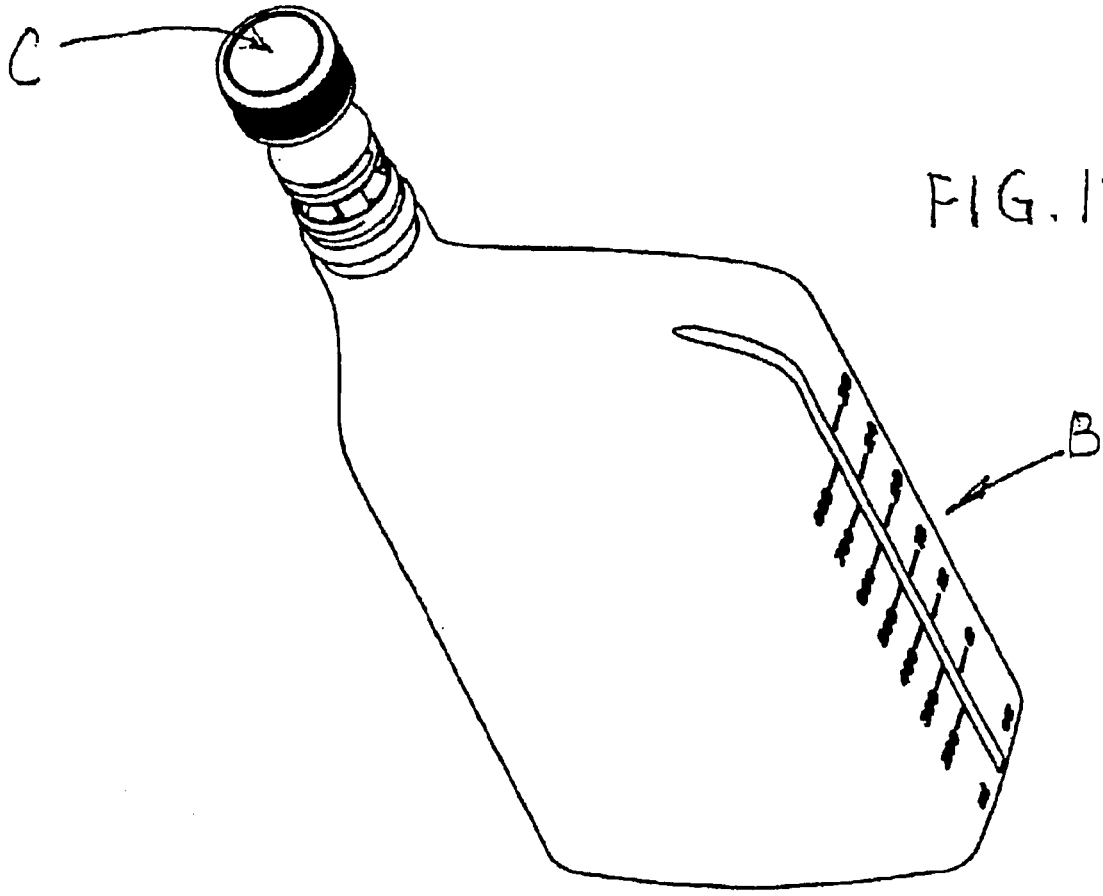
FIG. 12 is a pictorial view of the FIG. 11 embodiment in a dispensing position.
Figure 13:
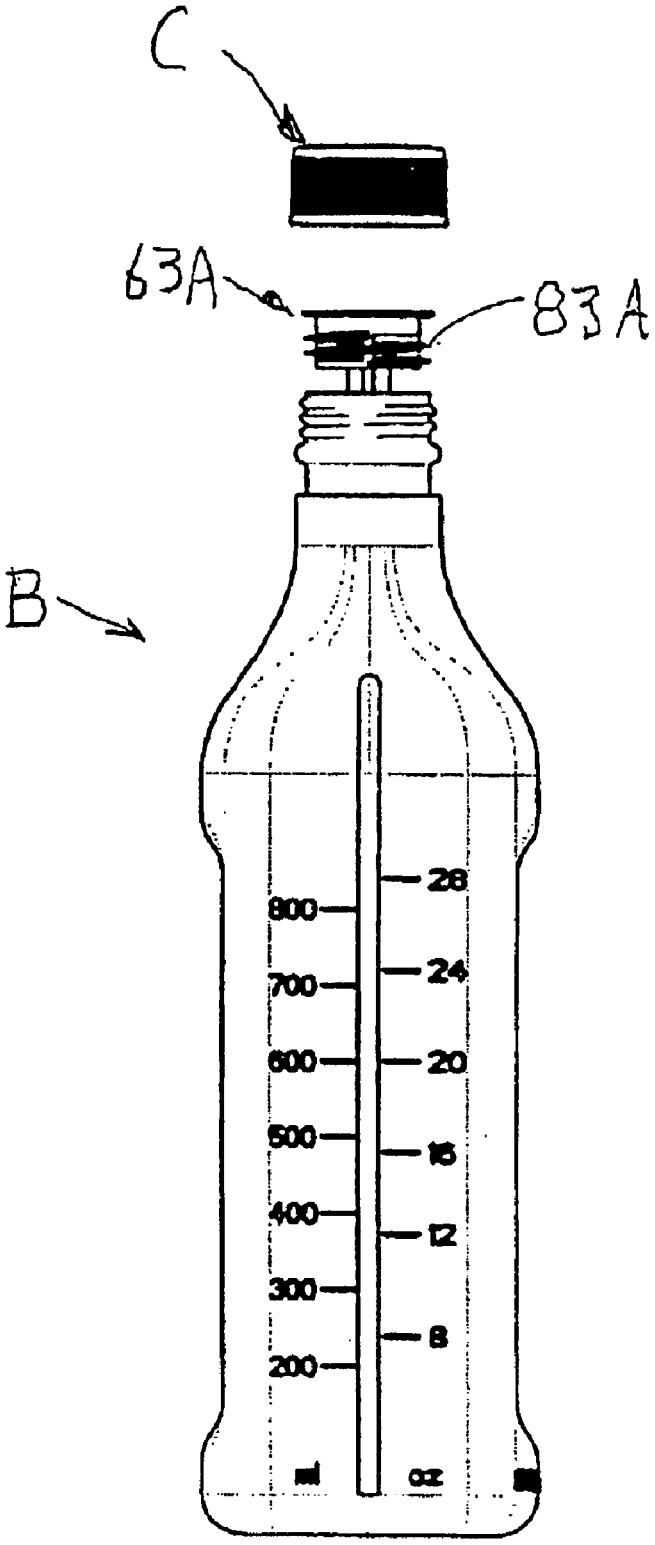
FIG. 13 is a right side view of the FIG. 12 embodiment.
Figure 14:
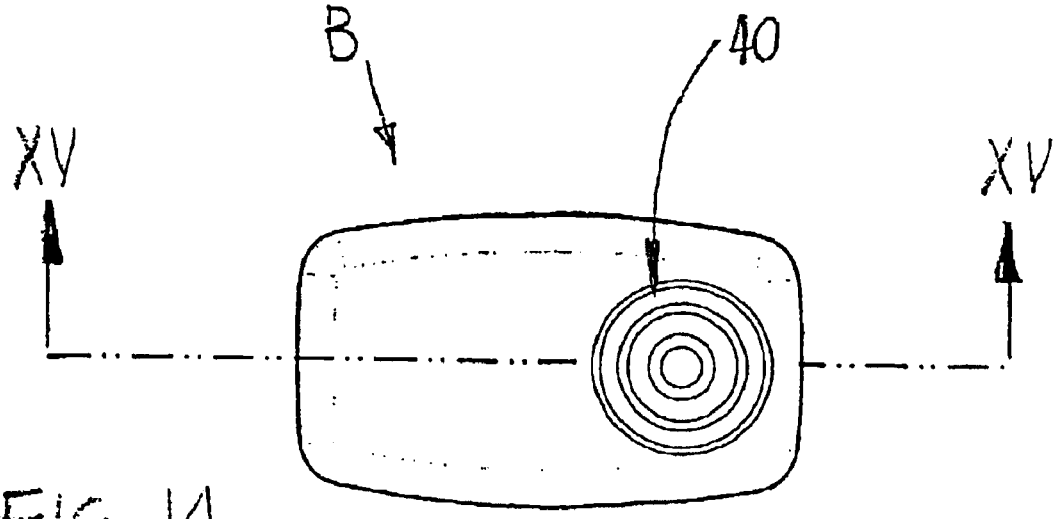
FIG. 14 is a bottom view of the FIG. 12 embodiment.

In FIG. 11, the spiral rib 83A has a closed, storage position in which its radially outer portion bears on the upward facing slope of the internal thread 28 of the spout 21. By providing a fin 83A of sufficient radial extent, its radially outer end 110 may extend fully into the valley 91 of the internal thread 28 of the bottle B and be slightly bent back thereby toward the body 80A, so as to further resist unintended opening displacement of the head 63A from its closed FIG. 11 storage position with the bottle B inverted and the cap C removed.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A liquid dispensing package, suited for dispensing motor oil, comprising:

a removable cap;

a bottle comprising top and bottom walls and a peripheral wall connecting said top and bottom walls and defining therewith a storage chamber, an outlet spout protruding from said top wall and removably carrying said cap, said bottom wall including a flexible push-in portion substantially aligned with said spout, said push-in portion having an upstanding boss protruding into said chamber and an axially flexible, annular surround connecting said boss to the remainder of the bottle bottom wall, said boss having a storage position protruding a first distance into said chamber and a dispensing position extending a second, further distance into said chamber;

a push rod in said bottle, said push rod having an elongate, generally longitudinally movable shaft extending between said push-in portion and spout, said push rod having a plug-like head fixed at the top portion of said shaft and having a storage position slidably disposed in the said spout and a dispensing position spaced outward from said spout, said push rod having a keeper member having a dispensing position in said bottle and limiting displacement of said head outboard beyond its said dispensing position, said push rod having a generally cup shaped base which opens toward said bottom wall and into which said boss telescopingly extends, said push rod base having an end wall opposing said boss and a peripheral skirt sleeved over said boss and axially opposing said axially flexible annular surround.

2. The apparatus of claim 1 in which said axially flexible annular surround comprises a radially outer annular fold extending interiorly of the bottle from the plane of said bottle bottom wall and a radially inner annular fold radially surrounded by said radially outer annular fold and which extends away from the interior of the bottle, said central boss being surrounded said annular inner fold and extending interiorly of the bottle therefrom.

3. The apparatus of claim 2, in which said radially outer annular fold defines a depression in said bottom wall of said bottle, said bottle being a molded plastics article, said radially outer annular fold, radially inner annular fold and boss being molded integrally with said bottom wall of said bottle.

4. The apparatus of claim 2, in which said inner annular fold defines a snap action push button having a stable outward storage position in which it axially overlaps a portion of said radially outer annular fold, and a stable axially inward dispensing position in which it curves continuously axially inward from said radially outer annular fold to said boss thereby eliminating the axial overlap between said annular folds.

5. The apparatus of claim 1 in which said generally cup shaped base is of outside diameter less than the inside diameter of said spout, said cup shaped base having an insertion position axially slidably disposed within said spout and opening toward said bottom wall of said chamber and boss.

6. A liquid dispensing package, suited for dispensing motor oil, comprising:

a removable cap;

a bottle comprising top and bottom walls and a peripheral wall connecting said top and bottom walls and defining therewith a storage chamber, an outlet spout protruding from said top wall and removably carrying said cap, said bottom wall including a flexible push-in portion substantially aligned with said spout;

a push rod in said bottle, said push rod having an elongate, generally longitudinally movable shaft extending between said push-in portion and spout, said push rod having a plug-like head fixed at the top portion of said shaft and having a storage position slidably disposed in the said spout and a dispensing position spaced outward from said spout, said push rod having a base which engages said push-in portion of said bottom wall, said push-in portion having storage and dispensing positions to which correspond storage and dispensing positions of said push rod, said outlet spout having a step facing into said chamber inboard of said storage position of said head, said push rod having a keeper member having a dispensing position in said bottle and limiting displacement of said head outboard beyond its said dispensing position, said keeper member comprising at least two evenly circumferentially spaced keeper portions axially spaced inboard of said head and axially opposing said step at an axial spacing corresponding to the axial spacing of said storage and dispensing positions of said head, said keeper portions having a common dispensing position simultaneously abutting said step and so maintaining said push rod blocked against tilting with respect to the length axis of said spout, said keeper portions in said dispensing position lying adjacent correspondingly evenly circumferentially spaced portions of said step and so maintaining said head substantially coaxial with said spout, whereby the flow of dispensed oil is in cross section substantially evenly circumferentially distributed around said head and maintained substantially coaxially extending from said spout.

7. The apparatus of claim 6 in which said keeper portions comprise two arms acutely angled from said shaft upward toward said step said arms being resiliently bendable, said arms having an insertion position resiliently radially inwardly bent sufficient to slidably engage the inner surface of said spout between the outer end of said spout and said step, said arms being obtusely angled with respect to said shaft in a direction toward the bottom wall of said bottle, the radially outer ends of said arms being sufficiently close to the interior surface of said spout inboard of said step as to positively prevent bending of said arms away from said step and toward the bottom of said bottle and thereby positively preventing removal of said push rod from said bottle with said arms disposed inboard of said step.

8. The apparatus of claim 7 in which said push rod includes a keeper bar spaced below and of length greater than said arms, said shaft and inverted cup shaped base and head and keeper arms and keeper bar being a one piece molded plastics element.

9. The apparatus of claim 6 in which said base is of inverted cup shape and opens toward said bottom wall of said bottle, said base being of outside diameter less than the inside diameter of said spout, said base having a range of installation positions axially spaced along and within said spout for slidable insertion of said push rod slidably into said bottle through said spout.

10. The apparatus of claim 6 in which top and bottom portions of said shaft have respective length axes which are laterally offset and substantially parallel, said shaft having a midportion connecting said top and bottom portions and angled with respect thereto.

11. The apparatus of claim 6 in which said spout and push-in portion have laterally offset but substantially parallel length axes, said push-in portion having a central boss protruding into said chamber, said base being generally cup shaped and snugly and coaxially receiving said boss, said head being substantially coaxially received in said spout, said boss and spout positively blocking rotation of said push rod in said bottle.

12. The apparatus of claim 6 in which said push rod includes a bar spaced below said top wall of said bottle and fixedly extending from said shaft at an acute angle and substantially more radially than axially of said shaft.

13. The apparatus of claim 6 including two said keeper members axially spaced on said shaft and opposing respective laterally spaced portions of said top wall of said bottle and at least closely approaching the latter in said dispensing position of said push rod.

14. The liquid dispensing package, suited for dispensing motor oil, comprising:

a removable cap a bottle comprising top and bottom walls and a peripheral wall connecting said top and bottom walls and defining therewith a storage chamber, an outlet spout protruding from said top wall and removably carrying said cap, said bottom wall including a flexible push-in portion substantially aligned with said spout;

a push rod in said bottle, said push rod having an elongate, generally longitudinally movable shaft extending between said push-in portion and spout, said push rod having a base which engages said push-in portion of said bottom wall, said push-in portion having storage and dispensing positions to which correspond storage and dispensing positions of said push rod, said push rod having a plug-like head fixed at the top portion of said shaft, said head having a storage position slidably disposed in said spout and a dispensing position spaced outward from said spout, said spout having an axially elongate, annular interior surface, said head having at least one, generally-circumferentially extending, flexible fin sealingly engaging said interior surface and forming therewith an axial liquid flow stop.

15. The apparatus of claim 14 in which said spout comprises a cap engaging, external thread and a corresponding internal thread, said fin extending in a spiral around said head, said internal thread comprising a spiral groove, said spiral fin being snugly and sealingly received in said spiral groove in said storage position of said head.

16. The apparatus of claim 15 in which said head comprises a top surface and an annular flange extending radially therefrom at said top surface, the diameter of said annular flange exceeding the diameter of said spout at the top of said spout so as to abut the latter in said storage position of said head, said flange being of diameter to be received in said cap, said cap having a top wall axially opposed to said flange, said cap having a position tightly threaded on said spout and fixedly trapping said flange of said head axially between the top of said spout and said cap, said fin being disposed on said head axially inboard of said flange, said fin and flange defining separate, redundant closures for said spout.

17. The apparatus of claim 14 including several axially spaced ones of said fins, said fins being annular and axially spaced from each other, said spout having a cap engaging, exterior thread and a corresponding internal thread, said annular fins resiliently engaging said cap at an internal peripheral wall thereof.

18. The apparatus of claim 17 in which said head comprises a top surface and an annular flange extending radially therefrom at said top surface, the diameter of said annular flange exceeding the diameter of said spout at the top of said spout so as to seat thereon in said storage position of said head, said flange being of diameter to be received in said cap, said flange and cap having axially opposed surfaces, said cap having a position tightly threaded on said spout and fixedly trapping said flange of said head axially against the top of said spout, said fin being disposed on said head axially inboard of said flange, said fin and flange defining separate, redundant closures for said spout.

* * * * *